US011612189B2

(12) United States Patent
Chao et al.

(10) Patent No.: US 11,612,189 B2
(45) Date of Patent: Mar. 28, 2023

(54) ASSEMBLY AND APPARATUS FOR FILLING CARTRIDGES WITH A LIQUID

(71) Applicants: Sam Chao, Sacramento, CA (US); Cale Crase, Sacramento, CA (US)

(72) Inventors: Sam Chao, Sacramento, CA (US); Cale Crase, Sacramento, CA (US)

(73) Assignee: CNC PACKAGING INC., Alcoa, TN (US)

( * ) Notice: Subject to any disclaimer, the term of this patent is extended or adjusted under 35 U.S.C. 154(b) by 0 days.

(21) Appl. No.: 17/402,581

(22) Filed: Aug. 15, 2021

(65) Prior Publication Data

US 2023/0051623 A1 Feb. 16, 2023

(51) Int. Cl.

| | |
|---|---|
| ***A24F 40/70*** | (2020.01) |
| ***B65B 3/12*** | (2006.01) |
| ***A24F 40/10*** | (2020.01) |
| ***B65B 3/26*** | (2006.01) |
| ***A24F 15/015*** | (2020.01) |

(52) U.S. Cl.

CPC ..... *A24F 40/70* (2020.01); *A24F 15/015* (2020.01); *A24F 40/10* (2020.01); *B65B 3/12* (2013.01); *B65B 3/26* (2013.01)

(58) Field of Classification Search

CPC ..... A24F 40/70; A24F 40/10; A24F 15/015; B65B 3/12; B65B 2/26; B65B 3/323

See application file for complete search history.

(56) References Cited

U.S. PATENT DOCUMENTS

| | | | | |
|---|---|---|---|---|
| 8,667,996 | B2 * | 3/2014 | Gonnelli | A61J 1/2089 604/407 |
| 10,440,989 | B2 * | 10/2019 | Gardella | B65B 39/12 |
| 10,443,589 | B2 * | 10/2019 | Goldbrunner | B67C 3/206 |
| 10,583,949 | B1 * | 3/2020 | Ellis | B65B 3/12 |
| 11,104,461 | B2 * | 8/2021 | Heaggans | B65B 3/32 |

* cited by examiner

*Primary Examiner* — Timothy L Maust

(74) *Attorney, Agent, or Firm* — Inventa Capital PLC

(57) ABSTRACT

An assembly of the present invention is designed specifically for filling vaporizer cartridges, pods, and other personal vaporizer systems with high viscosity extracts (oils). The assembly includes three main components such as the syringe station, the control box, and foot pedal. The control box includes the software to operate the assembly. The control box has controls for temperature and air pressure (for purging the vessel). The foot pedal operates the syringe for filling cartridges. The syringe station consists of a heated vessel, and a heated pneumatically operated syringe. The syringe system can be used in this configuration and can also be used as part of a larger, fully automated filling machine without limiting the scope of the present invention. The syringe system works well with viscous liquids.

14 Claims, 7 Drawing Sheets

ASSEMBLY AND APPARATUS FOR FILLING CARTRIDGES WITH A LIQUID

FIELD OF THE INVENTION

The present invention relates to a method and unit for filling a disposable electronic-cigarette cartridge with a liquid substance, and in particular, to the method and the apparatus for topping up cartridges, which must be filled to their edge with a liquid and be closed by a sealing membrane.

BACKGROUND OF THE INVENTION

Disposable electronic-cigarette cartridges have recently been proposed containing a hygroscopic (e.g. cotton-wool) wad impregnated with a viscous liquid substance containing nicotine and possibly also aromas. In actual use, the electronic cigarette heats the disposable cartridge to slowly volatilize (vapourize) the viscous liquid substance impregnating the hygroscopic wad.

Disposable cartridges of this sort are manufactured by producing a disposable cartridge with an open top end; inserting a dry hygroscopic wad inside the disposable cartridge; filling the disposable cartridge with a calibrated amount of liquid substance; and then plugging the open top end of the disposable cartridge with a plug permeable to vapor (i.e. that keeps in the liquid substance, but lets out the vapors produced by heating the liquid substance).

The most critical stage in the manufacture of disposable cartridges is filling them with the liquid substance. This is an extremely time-consuming job, partly on account of the liquid substance fed into the disposable cartridge having to impregnate the hygroscopic wad (a relatively slow process), and partly on account of the viscous nature of the liquid substance itself (i.e. its high density, which slows down its movement). As a result, currently used disposable cartridge manufacturing methods are extremely slow (i.e. have a low output rate) on account of the time taken to fill the disposable cartridges with the liquid substance.

The cartridge to be filled presents a cylinder ampoule of the kind comprising a cylindrical tube which has a first and a second end, the first end being end closed by a piston and at the second end having a neck part terminated by a circumferential flange against which a rubber membrane is pressed sealingly by a cap having means gripping behind the flange. Such ampoules are commonly filled with a liquid medicine preparation and are used in pen shaped injection devices by which set doses of the preparation may be injected until the ampoule is empty.

Prior art is replete with various applications for filling the cartridges. For example, one such prior art is an apparatus for filling a cartridge with a liquid comprises, a platform on which the cartridge is supported and which can be lifted relative to a stationary filling needle so that this filling needle is moved into the cartridge, a pump feeding liquid through the filling needle into the cartridge, a sensor head from which a beam of light is sent from one side of the cartridge to the other along a path immediately over an upper edge of the cartridge, and a reflector reflecting the light beam back to the sensor head, which is connected to a sensor box which produces a signal stopping the pump and causing the needle to be drawn out of the cartridge when this cartridge is full and the liquid forms a droplet over the opening of the cartridge, which droplet deflects the light beam.

Therefore, an opportunity exists for improved assembly and method for filling a disposable electronic-cigarette cartridge with a liquid substance.

SUMMARY OF THE INVENTION

The present invention relates to an assembly designed specifically for filling vaporizer cartridges, pods, and other personal vaporizer systems with high viscosity extracts (oils). The assembly includes a controller having a software to operate the assembly. An activator is cooperably connected to the controller to activate the assembly for filling vaporizer into the PVC. A syringe station is cooperable with the controller and the activator. The syringe station includes a vessel section for storing the fluids and a syringe section for injecting the fluid inside the PVC.

A plunger presents a fluid engaging surface located in the syringe section and movable about a first axis to and away from a needle adapter that engages the PVC. The vessel section is further defined by a vessel container for storing the fluids. The vessel container presenting a side wall and an inclined bottom extending to a nose portion to guide the fluids to the syringe section. The vessel container includes a lid to cover the open top of the vessel container.

A heating element is connected to the side wall of the vessel container. The heating element is connected to the controller to determine and regulate required temperature of the fluid and increase the temperature of the fluid if required. A heat shield surrounds the vessel container. The syringe section is connected to the heat shield. The syringe section includes the plunger, a pair of spacers, an air cylinder, a valve heater block, and a pair of check valves, with one of the valves defined between the needle adapter and the space defined in the syringe body and another of the check valves between the valve heater block and the syringe body.

The plunger is movable into a first position when the fluid is moved from the vessel section into the space defined in the syringe body and movable by the plunger away from the needle adapter and a second position as the fluid is pushed by the plunger to the needle adapter to fill the PVC as the controller signals the plunger travel distance between the fluid engaging surface and the needle adapter based on predetermined amount of the fluid needed to fill the PVC.

The objects and advantages of the present invention will be more readily apparent from inspection of the following specification, taken in connection with the accompanying drawing, wherein like numerals refer to like parts throughout and in which an embodiment of the present invention is described and illustrated.

The exact manner in which the foregoing and other objects and advantages of the invention are achieved in practice will become more clearly apparent when reference is made to the following detailed description of the preferred embodiments of the invention described in detail in the following specification and shown in the accompanying drawings, where in like reference numbers indicate corresponding parts throughout.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE INVENTION

Figure 1:
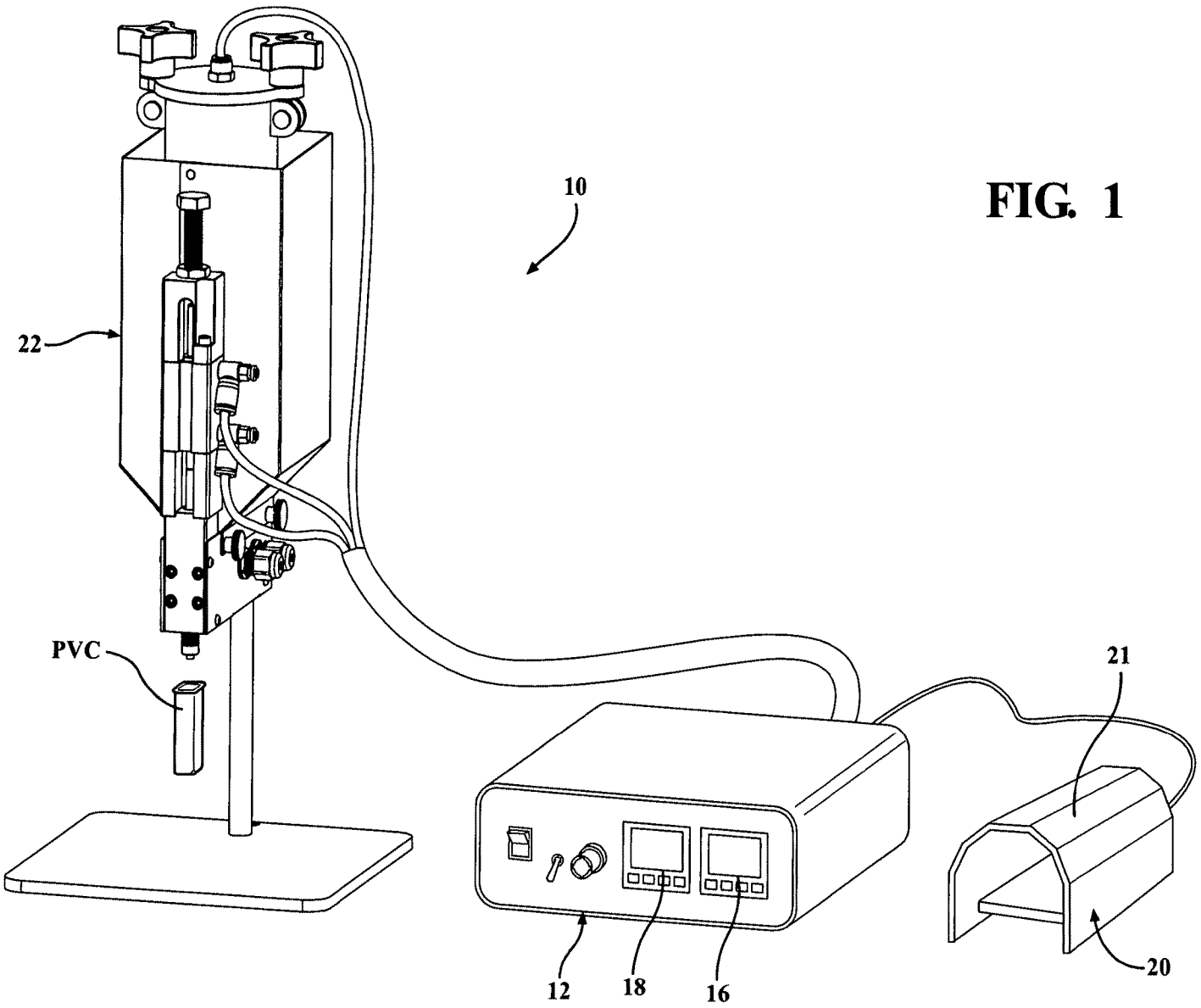
FIG. 1 is a general view of an assembly including three main components such as a syringe station, a control box, and a foot pedal the present invention.
Figure 2:
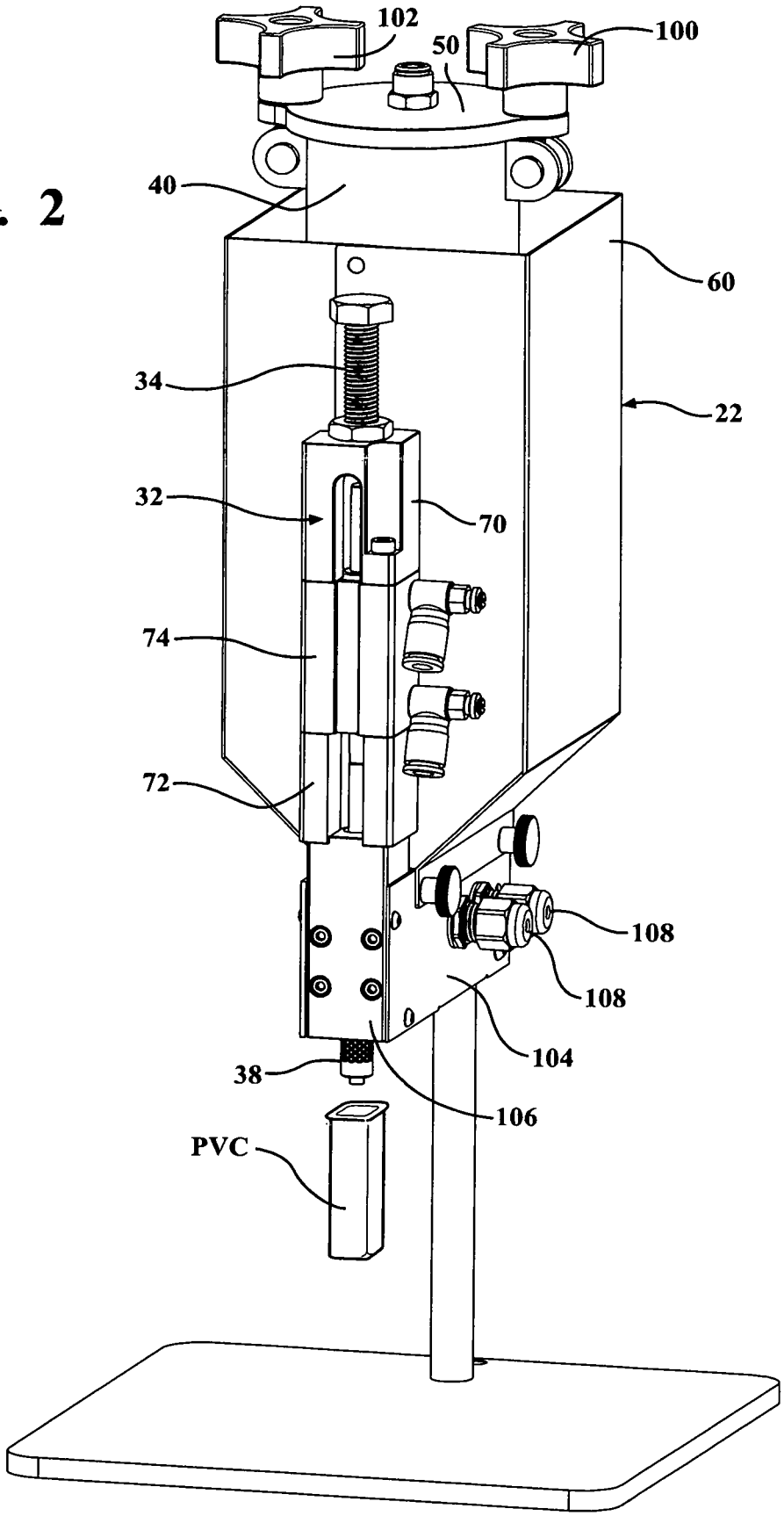
FIG. 2 is a general front view of the syringe station of the present invention.
Figure 3:
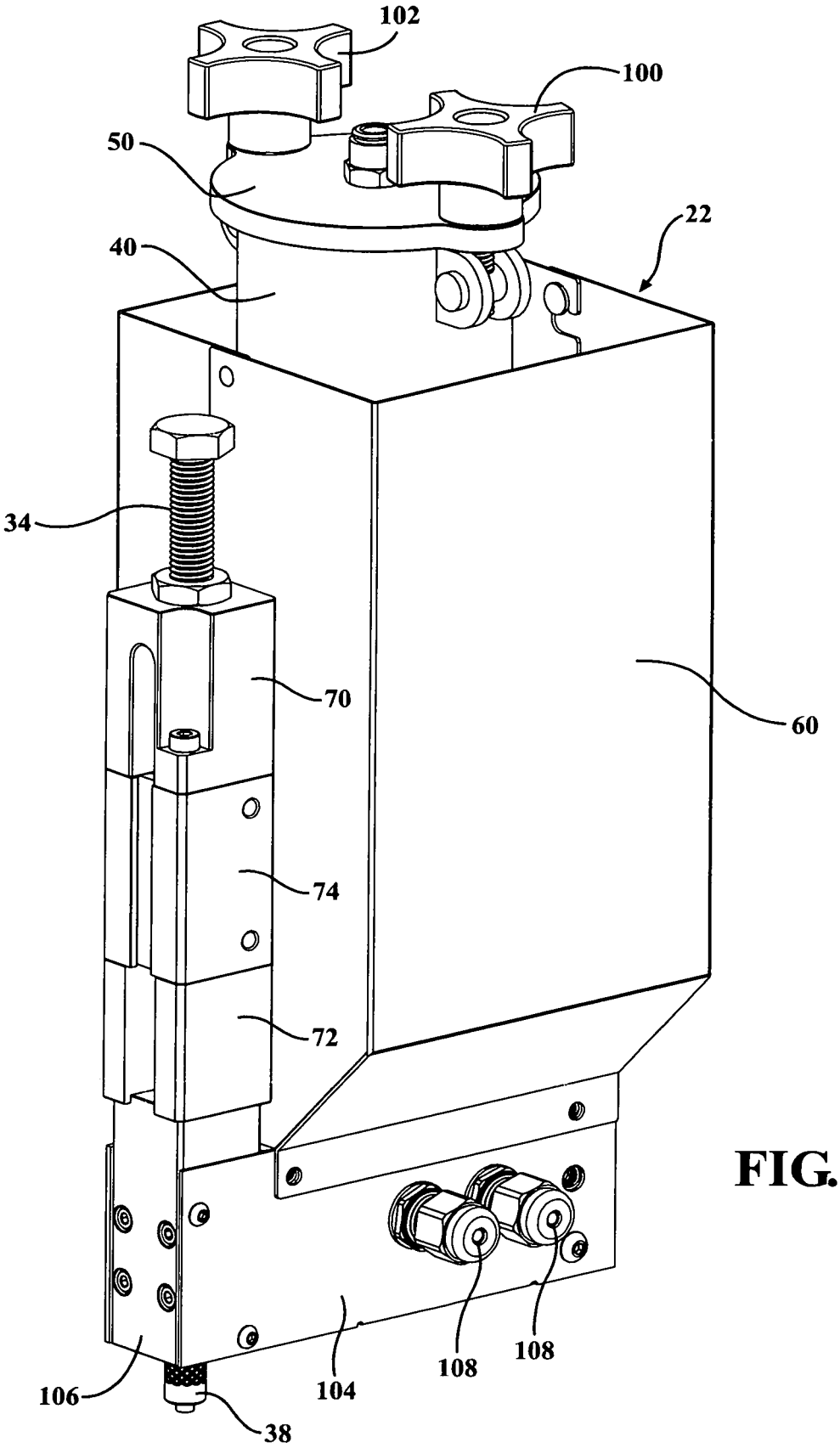
FIG. 3 is an expanded general front view of the syringe station of the present invention.
Figure 4:
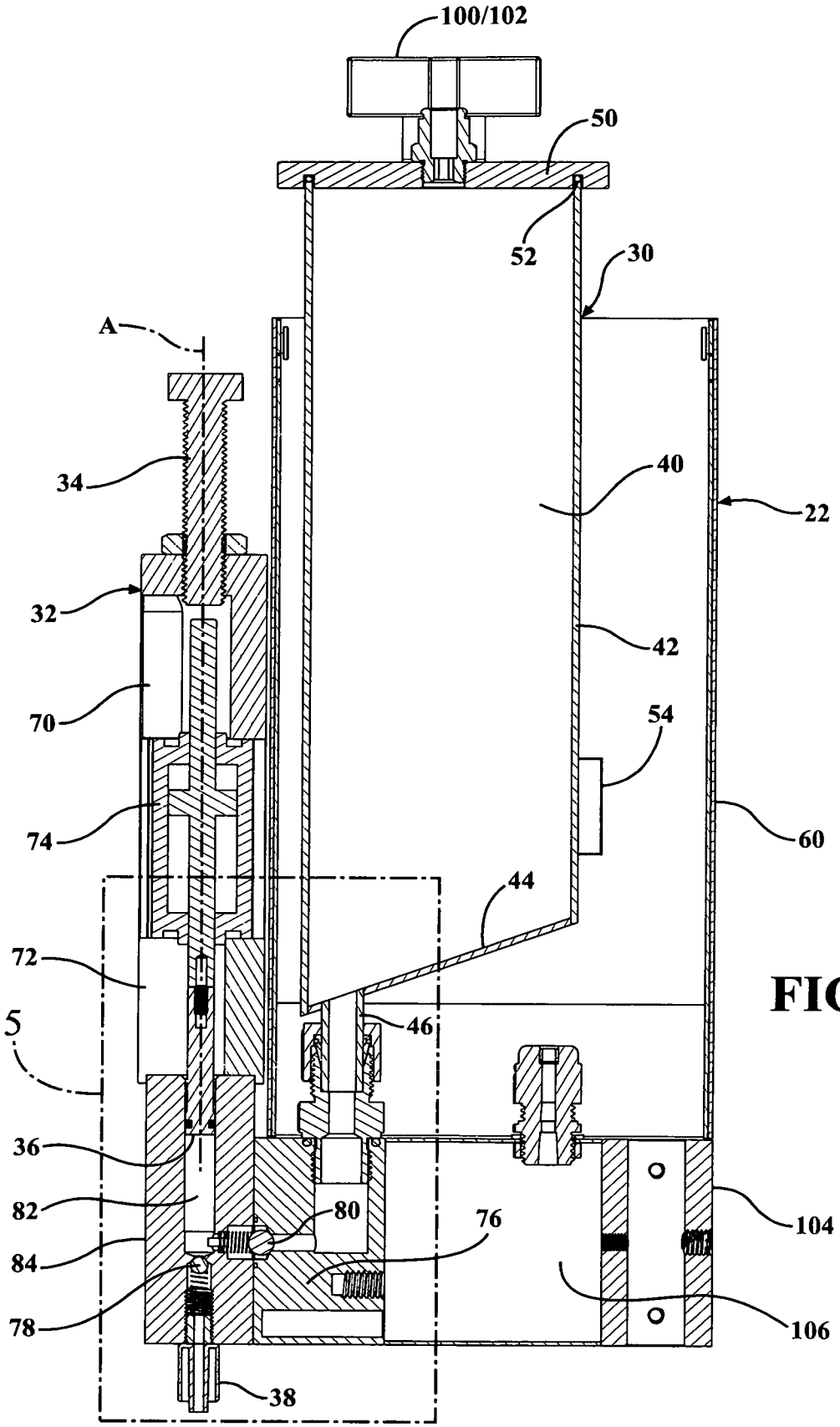
FIG. 4 is a cross sectional view of the syringe station of the present invention.

Referring to FIGS. 1 through 7, an assembly, generally shown at 10 in FIG. 1. The words "inner", "inwardly" and "outer", "outwardly" refer to directions toward and away from, respectively, a designated centerline or a geometric center of an element being described, the particular meaning being readily apparent from the context of the description. Additionally, as used herein, the singular forms "a," "an," and "the" include plural referents unless the context clearly dictates otherwise. Thus, for example, the term "module" is intended to mean one or more modules or a combination of modules. Furthermore, as used herein, the term "based on" includes based at least in part on. Thus, a feature that is described as based on some cause, can be based only on that cause, or based on that cause and on one or more other causes.

It will be apparent that multiple embodiments of this disclosure may be practiced without some or all of these specific details. In other instances, well-known process operations have not been described in detail in order not to unnecessarily obscure the present embodiments. The following description of embodiments includes references to the accompanying drawing. The drawing shows illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Alluding to the above, for purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

Alluding to the above, the filling machine (assembly) 10 is a manually operated cartridge filing machine that utilizes the syringe system of the present invention. The assembly includes a computer readable medium (the software). Because explicit identification of object-oriented constructs expressed through the syntax of high-level object-oriented programming languages is lost during compilation to binary code (e.g., translation of a source code definition or representation of an application to a binary code definition or representation of the application such as a machine code or byte-code definition), potential security vulnerabilities can be obscured during static analysis of the resulting binary code.

For example, because information about an object (e.g., the class on which the object is based, the size of the object, the number and types or sizes of properties of the object, and the number of functionalities accessible to the object via a dispatch table) is typically not expressed in binary code, determining whether indirect operations relative to the object expose security vulnerabilities can be difficult without the source code from which the binary code was generated.

As a specific example, an indirect operation can result in arbitrary code execution security vulnerabilities if the binary code does not include run-time validation to ensure that the indirect operation does not operate outside or beyond the object (i.e., at memory addresses not allocated to or shared by the object). Some binary code representations of applications, however, do include information about objects. Such information can be included in binary code as run-time type information (RTTI) or debugging information that is compiled into the binary code. Nevertheless, because the binary code representations of many applications do not include such information (e.g., to discourage reverse engineering of these applications), robust methodologies and systems for analyzing binary code based on (or derived from) source code using object-oriented techniques should not assume availability of such information.

Implementations discussed herein analyze operations described in binary code to identify objects based on those operations. Said differently, implementations discussed herein reconstruct, at least partially, objects (or representations of objects) by inferring the structure of such objects based on operations described in binary code. Thus, implementations discussed herein can identify objects and attributes such as a size thereof without referring to (or independent of) source code or explicit information about such objects which may or may not be included in the binary code.

Furthermore, implementations discussed herein perform security vulnerability analyses of binary code representations of applications using such objects. For example, implementations discussed herein can identify security vulnerabilities such as type confusion vulnerabilities that can result in arbitrary code execution, code injection, application failure, or other undesirable or unintended behavior of an application using information about objects identified by analysis of operations described in binary code.

Accordingly, implementations discussed herein with reference to analysis of operations described in binary code should be understood to refer to analysis of those operations using a binary code representation of a software module or a representation of the software module derived from the binary code representation.

A variable within a memory is a memory location at which one or more values can be stored. Such a memory location can be at a processor memory (e.g., a register or cache), at a system memory (e.g., a Random Access Memory (RAM) of a computing system), or at some other memory. Operations within binary code that operate on such variables can refer to a memory address (either absolute or relative to another memory address such as an offset from a stack pointer) of that memory location. Thus, the identifier (e.g., memory address) of an object can be stored as a value at a memory location with a memory address that is used by operations within the binary code.

Accordingly, as used herein, terms such as "identifier of an object" and "memory address of an object" should be understood to refer to the identifier (e.g., memory address) itself or to a variable at which a value representing the identifier is stored. As used herein, the term "module" refers to a combination of hardware (e.g., a processor such as an integrated circuit or other circuitry) and software (e.g., machine- or processor-executable instructions, commands, or code such as firmware, programming, or object code). A combination of hardware and software includes hardware only (i.e., a hardware element with no software elements), software hosted at hardware (e.g., software that is stored at a memory and executed or interpreted at a processor), or at hardware and software hosted at hardware.

As shown in FIGS. 1 through 7, the assembly 10 is designed specifically for filling vaporizer cartridges, pods, and other personal vaporizer systems with high viscosity extracts (oils), indicated as PVC in FIG. 1. The assembly includes a controller 12 having a software to operate the assembly 10 and a pair of monitors 16 and 18 to track temperature of the fluids. An activator, generally indicated at 20, is cooperably connected to the controller 12 to activate the assembly 10 for filling vaporizer the PVC. The activator 20 presents a pedal but can have any other form and is not intended to limit the scope of the present invention.

A syringe station, generally indicated at 22, is cooperable with the controller 12 and the activator 20. The syringe station 22 includes a vessel section, generally indicated at 30, for storing the fluids and a syringe section or a syringe, generally indicated at 32, for injecting the fluids inside the PVC. A plunger 34 presents a fluid engaging surface 36 located in the syringe section 32 and movable about a first axis A to and away from a needle adapter 38 that engages the PVC. The vessel section 30 is further defined by a vessel container 40 for storing the fluids. The vessel container 40 presenting a side wall 42 and an inclined bottom 44 extending to a nose portion 46 to guide the fluids to the syringe section 32. The vessel container 40 includes a lid 50 to cover the open top 52 of the vessel container 40.

A heating element 54 is connected to the side wall 42 of the vessel container 40. The heating element 54 is connected to the controller 12 to determine and regulate required temperature of the fluids and increase the temperature of the fluid if required. A heat shield 60 surrounds the vessel container 40. The syringe section 32 is connected to the heat shield 60. The syringe section 32 includes the plunger 34, a pair of spacers 70 and 72, an air cylinder 74, a valve heater block 76, and a pair of check valves 78, 80, with one of the valves 78 defined between the needle adapter 38 and the space 82 defined in the syringe body 84 and another of the check valves 80 between a valve heart block 90 and the syringe body 84.

The plunger 34 is movable into a first position when the fluid is moved from the vessel section 40 into the space 82 defined in the syringe body 84 and movable by the plunger 34 away from the needle adapter 38 and a second position as the fluid is pushed by the plunger 34 to the needle adapter 38 to fill the PVC as the controller 12 signals the plunger travel distance between the fluid engaging surface 36 and the needle adapter 38 based on predetermined amount of the fluid needed to fill the PVC.

A pair of fixing elements 100 and 102 to fixedly attach the lid 50 to the heated vessel 40. The heating shield 60 of a generally rectangular configuration surrounds the heated vessel 40. The syringe station 22 includes an electric cover 104 to cover a mounting bracket 106 to form an enclosed area for electrical connections 108.

Figure 5:
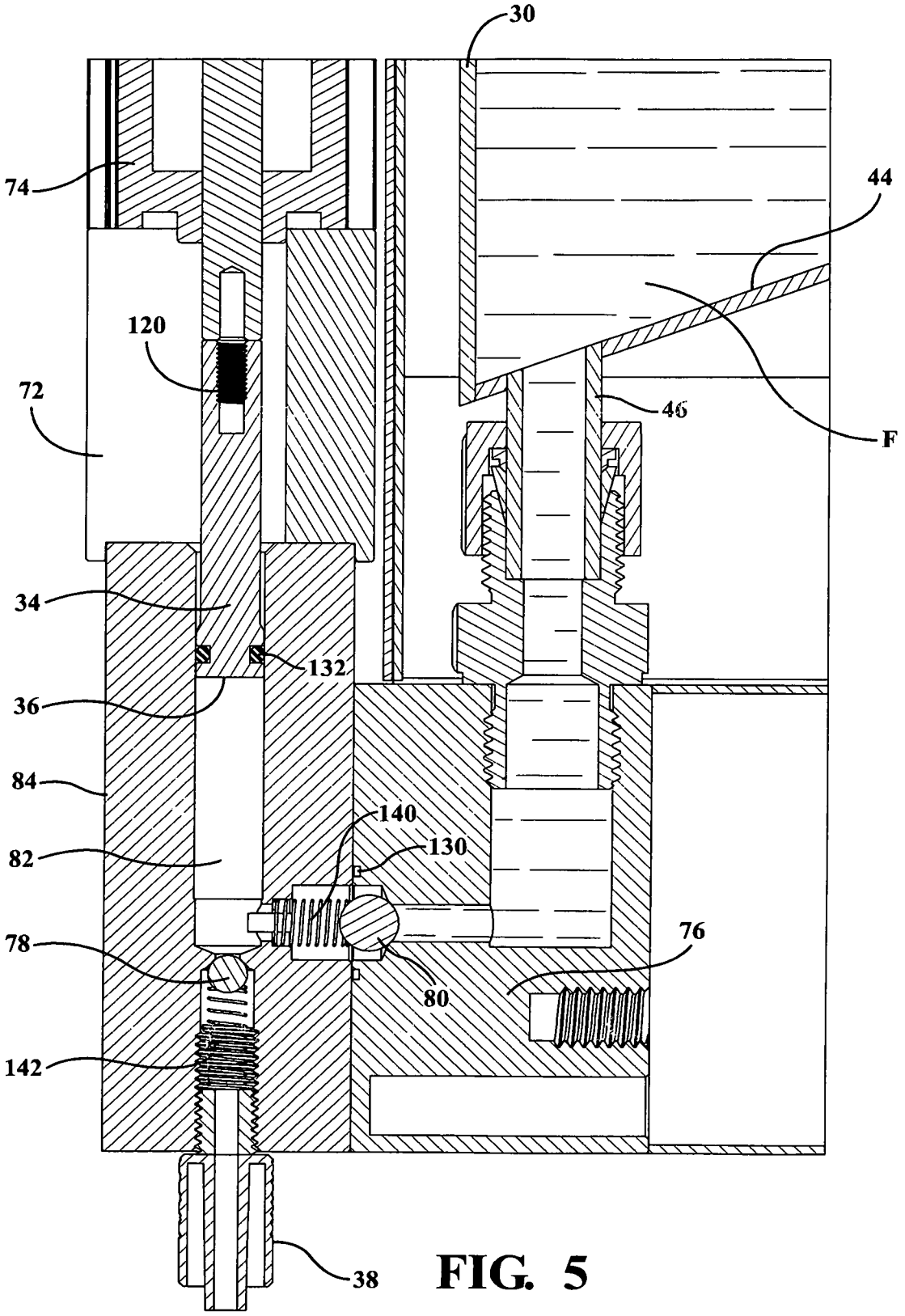
FIG. 5 is a cross sectional view of a liquid injection block of the syringe station wherein liquid is located in a vessel of the syringe station.
Figure 6:
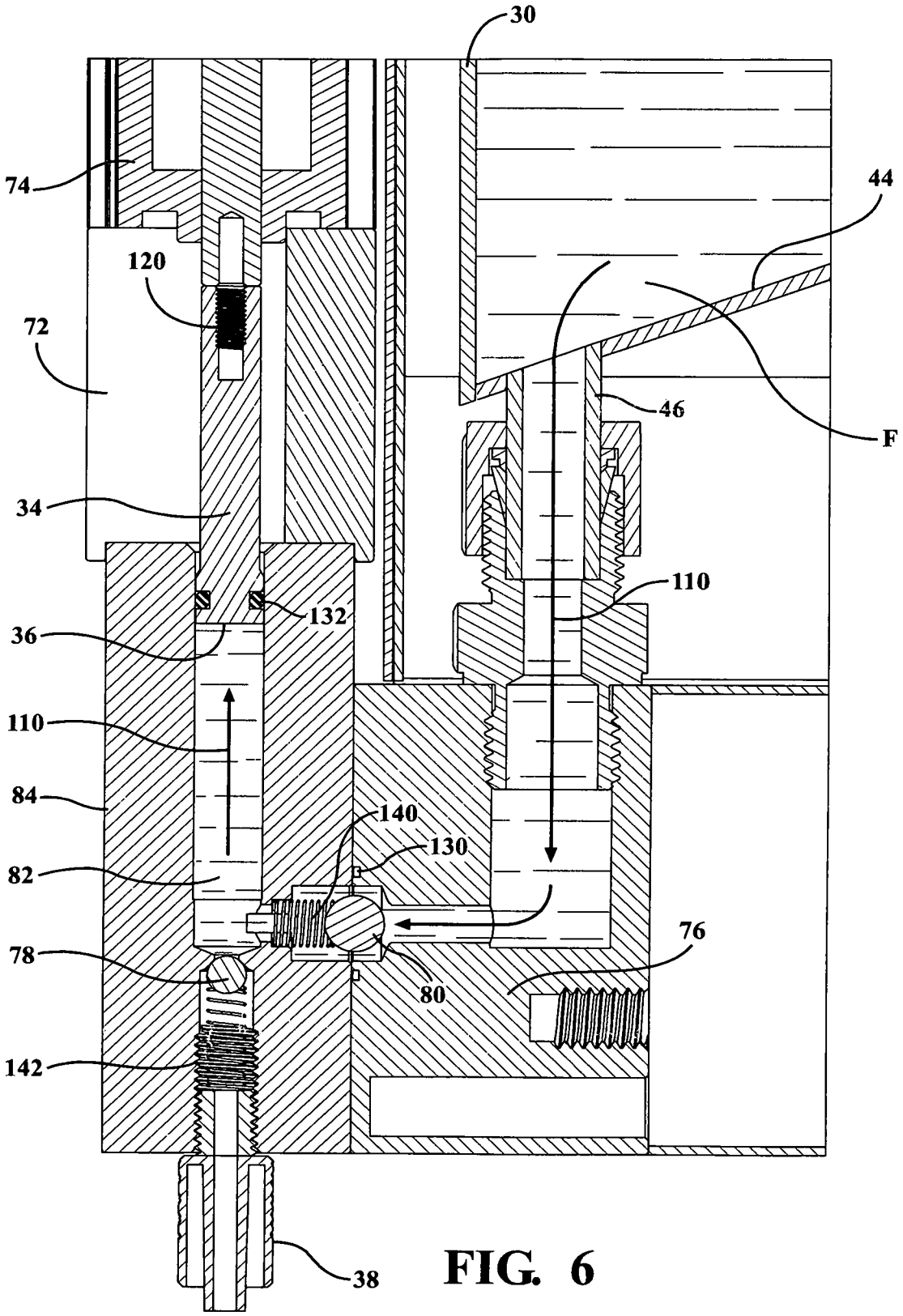
FIG. 6 is a cross sectional view of the liquid injection block of the syringe station wherein liquid, located in the vessel is moved to a space defined between an outlet check valve and a syringe plunger.
Figure 7:
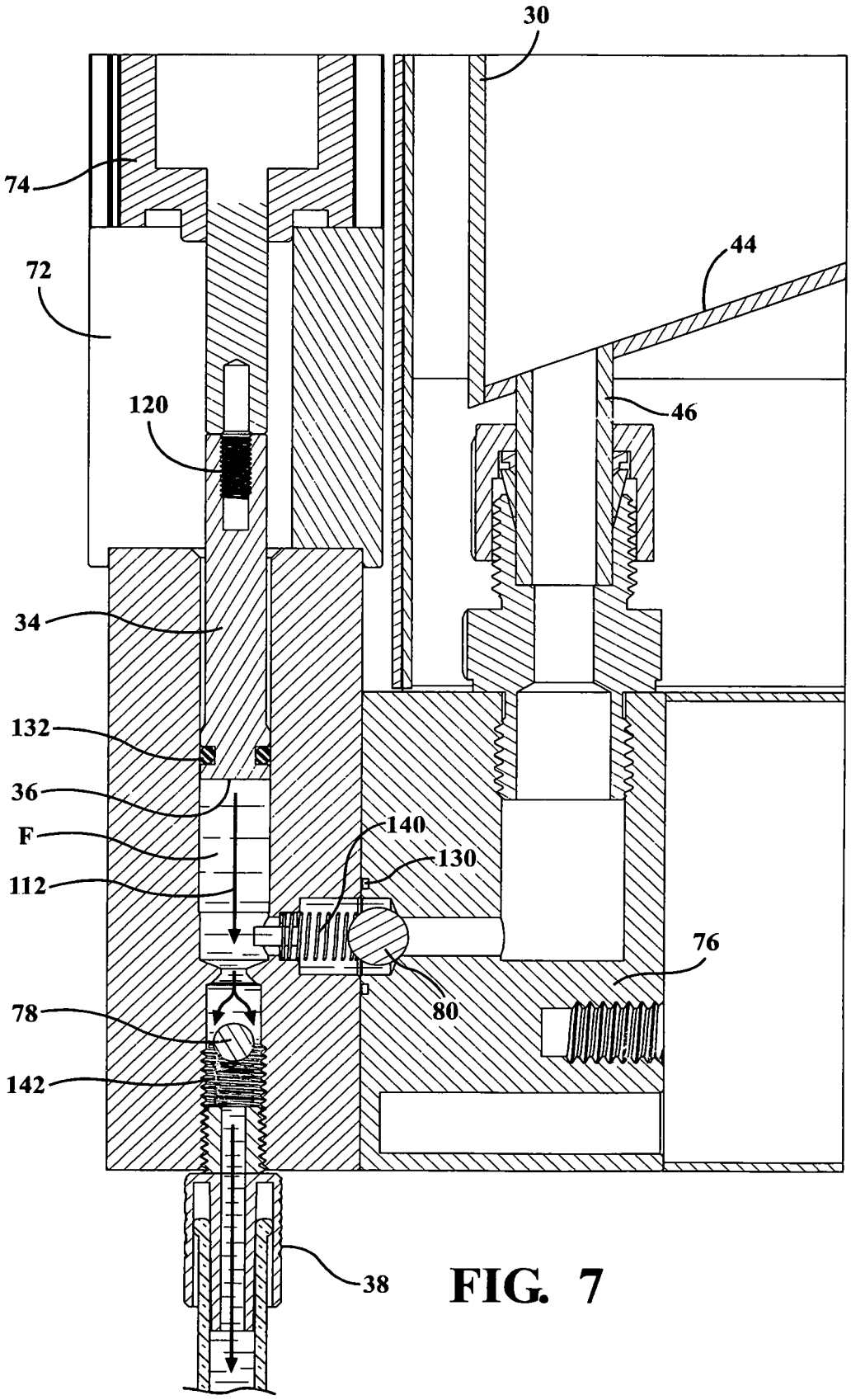
FIG. 7 is a cross sectional view of the liquid injection block of the syringe station wherein liquid, located in the space defined between the outlet check valve and the syringe plunger is forced into the outlet check valve to be further transferred to a lower lock needle adapter.

The assembly 10 can be used in this configuration and can also be used as part of a larger, fully automated filling machine without limiting the scope of the present invention. The assembly 10 works well with viscous liquids. As best shown in FIGS. 5 through 7, the fluids, such as oil F is kept warm with precise temperature control throughout the entire assembly 10 from the holding vessel 40 to the needle. The pneumatic plunger 34 allows for high pressure injection, up to 700 psi through the needle. This allows thick oils F to be forced through the needle very quickly. The design and arrangement of the check valves 78, 80 allows for proper operations with viscous liquids from 1 to 8000 centipoise.

As best shown in FIG. 6, lines 110 show the movement of the plunger 34 upwards, the fluid F is pulled through the inlet check valve 80 and into the syringe. Shown in lines 112, the plunger 74 is moved downward, the fluid F is pushed through the outlet check valve 78 and out through the needle.

The temperature of the oil is controlled in two zones: one zone is the vessel 40 and one is the syringe section 32. The vessel 40 uses the band heater 54 with an internal temperature sensor in conjunction with a PID temperature controller installed in the control box 12. This zone is usually set from 50-70 degrees celsius. The heater 54 on the vessel 40 is placed toward the bottom 44, near the syringe. The temperature gradient inside of the vessel 40 is not critical, if the oil inside the vessel 40 is warm enough to flow into the syringe 32. The syringe 32 uses a small cartridge heater and a thermocouple in conjunction with a PID temperature controller in the control box 12. This zone is generally set between 55-80 degrees celsius.

The temperature gradient inside of the syringe is tightly controlled to keep the oil warm and thin. The gradient is kept to a minimum by three main factors: the placement of the heater, the thermal mass of the syringe, and the good thermal coupling between syringe components. The syringe 32 is pneumatically operated via an air cylinder 120 attached to the plunger 34. The air cylinder 120 has the aforementioned flow control valves 78, 80 to control the speed of injection and refilling of the syringe. This allows for smooth, consistent operation as well as high injection pressures. The controllable flow speed allows the syringe operation to be adjusted so that the vacuum inside of the syringe has enough time to draw in oil and refill the syringe for the next injection. Thicker oils require more time to flow into the syringe than thin oils.

The controllable flow speed also allows the injection speed to be controlled, so that the oil has enough time to flow into small pockets inside of certain types of cartridge. The air cylinder 120 can provide a large amount of pressure to the plunger, which in turn can generate pressures of up to 700 psi inside of the syringe. This allows for thicker oils to be forced quickly through very small needles, for example a 24 ga 2" long needle. Lower pressure systems can take a very long time to push a standard dose (0.5-1.0 ml) through such a small syringe. The high pressure also eliminates the need to heat the needle. Even if the oil cools and becomes extremely viscous inside of the needle the pressure is large enough to push out the blockage and continue with normal operation.

The check valves 78, 80 and seals 130, 132 inside of the syringe 32 are designed to allow highly viscous oils to flow with little restriction. The valves 78, 80 are also designed to withstand the high pressures inside of the syringe 32. A spring 140 on the inlet check valve 80 is finely tuned for minimal pop-off pressure, which reduces the amount of vacuum needed to open the valve 80 and refill the syringe 32. A spring 142 on the outlet valve 78 is tuned for a high pop-off pressure, to ensure that no oil or air leaks back through during refilling. These factors facilitate high dosage accuracy as well as consistent operation.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An assembly for filling vaporizer cartridges, pods, and other personal vaporizer systems (a PVC) with a fluid, said assembly comprising:

a controller including a software to operate said assembly;

an activator cooperably connected to said controller to activate said assembly for filling the PVC; and a syringe station cooperable with said controller and said activator, said syringe station including a vessel section for storing the fluid and a syringe section for injecting the fluid inside the PVC, said syringe section comprising:

a plunger, a first spacer section, an air cylinder section, a second spacer section, a syringe body, and a needle adapter connected thereto and configured to engage the PVC, said plunger being movably inserted through said first spacer section and having a fluid engaging surface disposed in said syringe body, said air cylinder section is arranged between said first and second spacer sections such that said first and second spacer sections are stationary relative one another;

wherein said plunger is movable along an axis towards and away from said needle adapter such that said plunger is movable into a first position away from said needle adapter as the fluid is drawn from said vessel section into a space defined in said syringe body and a second position towards said needle adapter as the fluid is pushed by said fluid engaging surface of said plunger towards said needle adapter to fill the PVC; and wherein said controller is configured to regulate a travel distance of said plunger to control a gap between said fluid engaging surface and said needle adapter based on predetermined amount of the fluid needed to fill the PVC.

2. The assembly as set forth in claim 1, wherein said vessel section is further defined by a vessel container for storing the fluid, said vessel container having a side wall and an inclined bottom extending to a nose portion to guide the fluid to said syringe section.

3. The assembly as set forth in claim 1, wherein said vessel container has an open top and includes a lid to cover the open top of said vessel container.

4. The assembly as set forth in claim 2, further comprising a first heating element connected to the side wall of said vessel container, said first heating element is connected to said controller in order to determine and regulate required temperature of the fluid in said vessel container.

5. The assembly as set forth in claim 1, further comprising a heat shield surrounding said vessel container, said syringe section is connected to said heat shield.

6. The assembly as set forth in claim 1, wherein said syringe section includes a valve heater block connected to said syringe body.

7. The assembly as set forth in claim 6, further comprising an inlet check valve and an outlet check valve, wherein said outlet check valve is defined between said needle adapter and said space defined in the syringe body, and wherein said inlet check valve is defined between said valve heater block and said syringe body.

8. The assembly as set forth in claim 7, wherein said inlet check valve includes a first spring tuned for a minimal pop-off pressure, and wherein said outlet check valve includes a second spring tuned for a high pop-off pressure.

9. The assembly as set forth in claim 4, wherein said syringe section includes a second heating element connected to said syringe body to regulate temperature of the fluid in said space of said syringe body.

10. The assembly as set forth in claim 3, wherein said lid includes one or more fixing elements to secure said lid to said vessel container.

11. An assembly for filling vaporizer cartridges, pods, and other personal vaporizer systems (PVC) with a fluid, said assembly comprising:

a controller including a software to operate said assembly;

an activator operatively connected with said controller to activate said assembly for filling the PVC; and a syringe station operatively connected with said controller and activator, said syringe station including a vessel section for storing the fluid and a syringe section for injecting the fluid inside the PVC, said syringe section comprising:

a plunger;

a first spacer section, a second spacer section, and an air cylinder section arranged therebetween such that said first and second spacer sections are stationary relative one another;

a syringe body connected to said second spacer section, said plunger being movably inserted through said first spacer section and having a fluid engaging surface disposed in said syringe body; and a needle adapter connected to said syringe body, said needle adapter is configured to engage the PVC;

wherein said vessel section includes a first heating element attached thereto and said syringe body includes a second heating element attached thereto;

wherein said plunger is movable along an axis towards and away from said needle adapter such that said plunger is movable into a first position away from said needle adapter as the fluid is drawn from said vessel section into a space defined in said syringe body and a second position towards said needle adapter as the fluid is pushed by said fluid engaging surface of said plunger towards said needle adapter to fill the PVC; and wherein said controller is configured to regulate a travel distance of said plunger to control a gap between said fluid engaging surface and said needle adapter based on predetermined amount of the fluid needed to fill the PVC.

12. The assembly as set forth in claim 11, wherein said syringe body includes a thermocouple connected with a PID temperature controller in said controller of said assembly.

13. The assembly as set forth in claim 11 further comprising an inlet check valve connected to said syringe body and an outlet check valve defined between said needle adapter and said space defined in the syringe body.

14. The assembly as set forth in claim 13, wherein said inlet check valve includes a first spring tuned for a minimal pop-off pressure, and wherein said outlet check valve includes a second spring tuned for a high pop-off pressure.

* * * * *